US010619116B2

(12) United States Patent
Hosseini

(10) Patent No.: US 10,619,116 B2
(45) Date of Patent: Apr. 14, 2020

(54) GLUE GREASE AND METHOD OF MAKING

(71) Applicant: Mahdi Hosseini, Karaj (IR)

(72) Inventor: Mahdi Hosseini, Karaj (IR)

( * ) Notice: Subject to any disclaimer, the term of this patent is extended or adjusted under 35 U.S.C. 154(b) by 123 days.

(21) Appl. No.: 15/853,617

(22) Filed: Dec. 22, 2017

(65) Prior Publication Data

US 2019/0194563 A1 Jun. 27, 2019

(51) Int. Cl.

| | |
|---|---|
| ***C10M 105/04*** | (2006.01) |
| ***C10M 105/72*** | (2006.01) |
| ***C10M 143/12*** | (2006.01) |
| ***C10M 177/00*** | (2006.01) |
| ***C10M 169/02*** | (2006.01) |
| *C10N 70/00* | (2006.01) |

(52) U.S. Cl.

CPC ..... *C10M 105/04* (2013.01); *C10M 105/72* (2013.01); *C10M 143/12* (2013.01); *C10M 169/02* (2013.01); *C10M 177/00* (2013.01); *C10M 2203/0206* (2013.01); *C10M 2203/1006* (2013.01); *C10M 2205/06* (2013.01); *C10N 2070/00* (2013.01); *C10N 2230/02* (2013.01); *C10N 2230/06* (2013.01); *C10N 2230/08* (2013.01); *C10N 2230/43* (2013.01); *C10N 2240/02* (2013.01); *C10N 2240/04* (2013.01); *C10N 2250/02* (2013.01); *C10N 2250/10* (2013.01); *C10N 2260/09* (2013.01)

(58) Field of Classification Search

CPC ..... C10M 105/04; C10M 105/72; C10M 143/12; C10M 177/00; C10M 2203/0206; C10M 2205/06; C10N 2070/00; C10N 2230/06; C10N 2230/08; C10N 2230/43; C10N 2250/10; C10N 2260/09; C10N 2230/02

See application file for complete search history.

(56) References Cited

U.S. PATENT DOCUMENTS 3,353,971 A * 11/1967 Savage ..... C09G 1/10 106/10

* cited by examiner

*Primary Examiner* — Cephia D Toomer
(74) *Attorney, Agent, or Firm* — Azadeh Saidi

(57) ABSTRACT

Glue Grease, has been designed and made as a lubricant to be used in moving mechanical parts in difficult environmental conditions as an anti-abrasion material in order to increase the longevity of parts prone to friction.

7 Claims, 1 Drawing Sheet

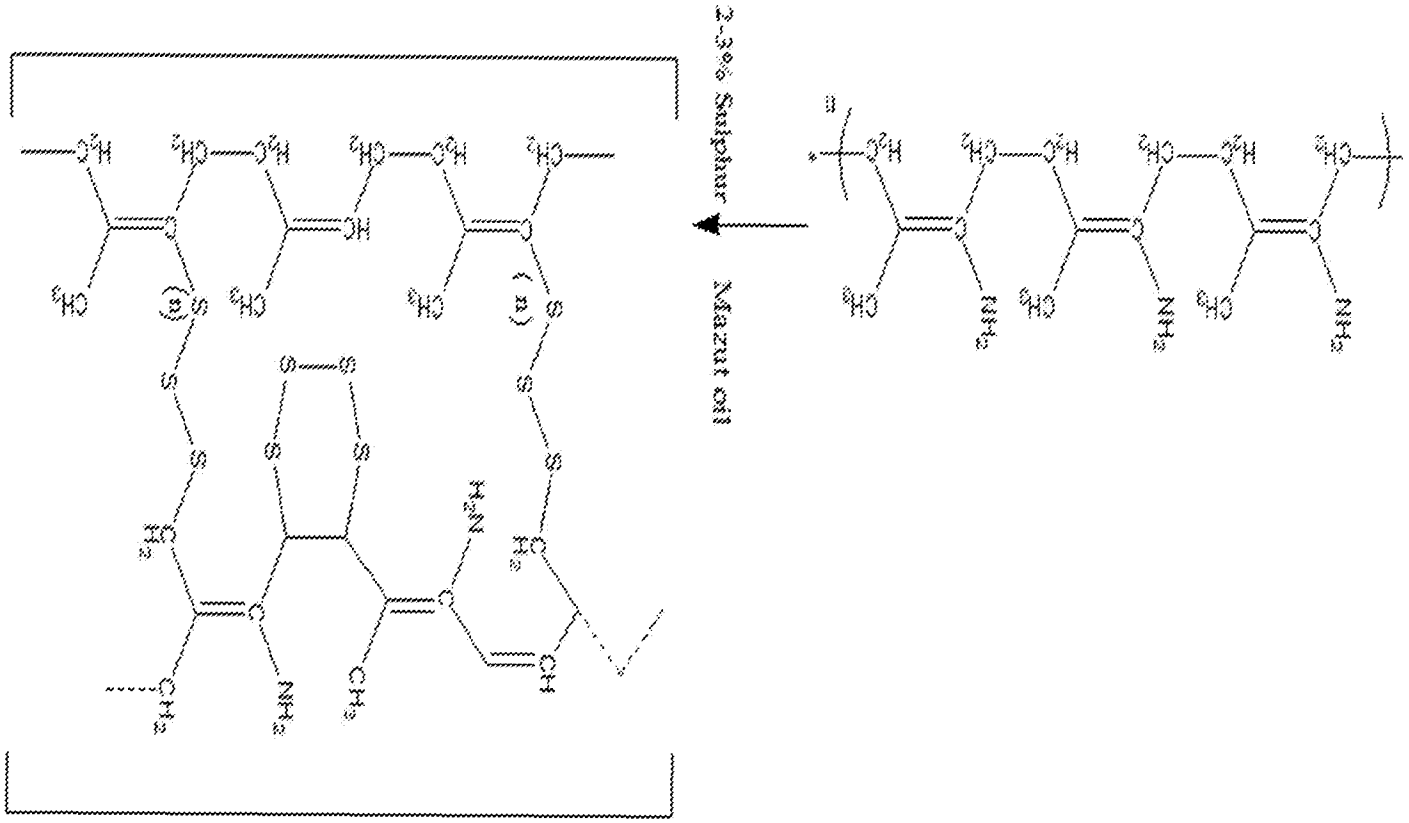
2-3% Sulphur
Mazut oil

GLUE GREASE AND METHOD OF MAKING

BACKGROUND OF THE INVENTION

Grease is a paste like lubricant which has been used to lubricate the moving parts of machines for a long time. Various types of grease are categorized according to six criteria which come below:

Application of the grease
The additives used in its composition
The type of synthetic based oils
The grade of the grease
Maximum operational temperature allowed
Minimum operational temperature allowed The two most considered criteria among the above are the additives used and the application. If we look more closely at the efficiency of traditional types of grease in industry and their impact on the longevity of parts, we come to the conclusion that there has been a deficiency in traditional types of grease; namely, these greases only facilitate a sliding movement, and are not able to prevent abrasion between metal parts. Therefore metal parts get abraded and destroyed in a short time. The idea for the invention of Glue Grease came from this destructive process. When we considered the high cost of replacing abraded parts, we decided to design and invent a type of grease with anti-abrasion characteristics in order to prevent premature wearing of parts and lower operational costs.

BRIEF DESCRIPTION OF THE DRAWINGS

FIG. 1 displays the formulation for the present invention

SUMMARY OF THE INVENTION

In today's industrial world lowering costs and increasing product quality are among the highest priorities of all industries. Glue Grease has been designed and made with an eye to satisfying the same priorities. Its application not only adds considerably to the operational quality of industrial products, but also increases the operational lifespan of machine parts through its anti-abrasion characteristics.

In addition, there are many parts in machines whose only purpose is to keep the grease between moving parts. With the application of Glue Grease these parts can be left out because due to its high elasticity, Glue Grease does not disappear from the surface of moving parts. This high elasticity of Glue Grease creates the potential to decrease operational costs through elimination of parts which hold the grease in place.

DETAILED DESCRIPTION OF THE INVENTION

In the composition of Glue Grease, Mazut oil, which belongs to the family of bunker oils, has been used as the oil base. Mazut oil is composed of Alkane hydrocarbon chains containing from 20 to 70 carbon atoms in each chain. It also contains one percent of aromatic rings. This oil is chemically inactive especially in metal and organo-metal compounds. This makes it an ideal oil base for Glue Grease.

Various types of Mazut oils are categorized according to their Sulphur content:

"Low Sulphur" is a Mazut with a Sulphur content of 1.0-1.5%

"Normal Sulphur" is a Mazut with a Sulphur content of 1.5-2.0%

"High Sulphur" is a Mazut with a Sulphur content of 2.5-3.0%

The Sulphur content is mostly affected by the source feedstock.

The next compound used in the composition of Glue Grease is a type of adhesive polymer called Latex, which can be acquired both from natural sources such as plant saps and synthetically through polymerization of isoprene. It is used extensively in the production of rubber. This polymer has a pure white color and is elastic. This elasticity makes it an ideal compound for adding elasticity to Glue Grease. Moreover, it doesn't chemically react with metal and organo-metal compounds.

When exposed to the outside environment, Latex quickly dries up. In order to prevent this process and prepare the Latex for use, it is dissolved in Ammonia.

BEST MODE

We place one liter of a low-Sulphur Mazut oil in a two-liter mixer at a temperature of 25 degrees centigrade. In a separate mixer we pour 400 grams of Latex and 700 grams of %44 Ammonia, and turn on the mixer until a homogenous white solution is created. Then we add 300 ml. of the Latex and Ammonia solution to the first mixer which contained one liter of Mazut oil.

Then we turn on the mixer and let it run for three hours to allow for vulcanization process to happen between the Latex and the Sulphur content of Mazut oil. In this process Latex is oxidized and Sulphur turns into Sulphide. This process creates elasticity and anti-abrasion characteristics in the resulting Glue Grease.

After three hours we turn off the mixer and let the compound rest for 12 hours. During this time numerous tiny bubbles appear on the surface of the compound. These bubbles show the separation of Ammonia and Sulphate gases from the compound as a result of the oxidization process. After 12 hours we will have a paste like black polymer which is oily and elastic. This compound is Glue Grease and can be used in car differentials, gearboxes and ball bearings.

The capabilities of Glue Grease comprises but not limited to being Anti-abrasion and lubricant; having high viscosity and elasticity; being resistance to temperatures as high as 450 degrees centigrade; and resistance to temperatures as low as −90 degrees centigrade.

The compounds and devices used in its production comprises low Sulphur Mazut oil; Natural Latex; Ammonia and Mixer. FIG. 1 displays the formulation of Glue grease.

The invention claimed is:

1. A method for making glue grease, comprising

A) Mixing in a first mixer, a quantity of Latex and Ammonia until a homogenous white solution is formed;

B) Mixing in a second mixer; a volume of Mazut oil with a portion of said white solution;

C) Turning on said second mixer and letting it run for a first period of time; creating a second solution; and D) Turning off said second mixer and letting said second solution to sit for a second period time; creating said glue grease.

2. The method of claim 1, wherein said Mazut oil is composed of Alkane hydrocarbon chains containing from 20 to 70 carbon atoms in each chain; and wherein said Mazut oil is low-Sulphur Mazut oil, with a Sulphur content of 1.0-1.5%.

3. The method of claim 2, wherein said Latex is an adhesive polymer acquired both from natural sources including plant saps and synthetically through polymerization of isoprene; wherein either form is suitable.

4. The method of claim 3, wherein said first period of time is 3 hours, wherein a vulcanization process happens between said Latex and said Sulphur content of said Mazut oil.

5. The method of claim 4, wherein in said 3 hours, said Latex is oxidized and said Sulphur turns into Sulphide, having an elasticity and anti-abrasion characteristic.

6. The method of claim 5, wherein said second period of time is at least 12 hours, and wherein said glue grease comprises a paste like black polymer that is oily and elastic.

7. The method of claim 6, wherein said quantity is 400 grams of said Latex and 700 grams of 44% Ammonia, and wherein said portion of said white solution is 300 ml of said first solution, and wherein said volume is 1 liter of said low-Sulphur Mazut oil.

* * * * *